US010685617B2

(12) United States Patent
Im et al.

(10) Patent No.: US 10,685,617 B2
(45) Date of Patent: Jun. 16, 2020

(54) DISPLAY DEVICE HAVING CHARGING RATE COMPENSATING FUNCTION

(71) Applicant: SAMSUNG DISPLAY CO., LTD., Yongin-si, Gyeonggi-Do (KR)

(72) Inventors: Taegon Im, Gwangmyeong-si (KR); Boyeon Kim, Seoul (KR); Dongwon Park, Asan-si (KR); Junghwan Cho, Asan-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 72 days.

(21) Appl. No.: 16/110,304

(22) Filed: Aug. 23, 2018

(65) Prior Publication Data

US 2019/0066621 A1 Feb. 28, 2019

(30) Foreign Application Priority Data

Aug. 25, 2017 (KR) ..... 10-2017-0108222

(51) Int. Cl.
*G09G 3/36* (2006.01)

(52) U.S. Cl.
CPC ..... *G09G 3/3688* (2013.01); *G09G 3/3677* (2013.01); *G09G 3/3696* (2013.01); *G09G 2310/027* (2013.01); *G09G 2310/0291* (2013.01); *G09G 2310/08* (2013.01); *G09G 2320/0233* (2013.01); *G09G 2320/041* (2013.01)

(58) Field of Classification Search
CPC ..... G09G 2310/027; G09G 2310/0291; G09G 2310/08; G09G 2320/0233; G09G 2320/041; G09G 3/3677; G09G 3/3688; G09G 3/3696
See application file for complete search history.

(56) References Cited

U.S. PATENT DOCUMENTS

| | | | | |
|---|---|---|---|---|
| 8,994,444 | B2 | 3/2015 | Baek et al. | |
| 2004/0041605 | A1* | 3/2004 | Kizer | G06F 1/10 327/159 |
| 2011/0050307 | A1* | 3/2011 | Lin | H03K 5/1565 327/175 |
| 2015/0325214 | A1 | 11/2015 | Ryu | |
| 2016/0379548 | A1 | 12/2016 | Shin et al. | |

FOREIGN PATENT DOCUMENTS

| | | |
|---|---|---|
| KR | 10-0709702 | 4/2007 |
| KR | 10-0912093 | 8/2009 |
| KR | 10-1562899 | 10/2015 |
| KR | 10-2017-0002098 | 1/2017 |
| KR | 10-2017-0023292 | 3/2017 |

* cited by examiner

*Primary Examiner* — Dmitriy Bolotin

(74) *Attorney, Agent, or Firm* — F. Chau & Associates, LLC

(57) ABSTRACT

A display device having a charging compensation circuit to reduce/eliminate display stains based on pixels being charged at unequal charging rates. A data driving circuit of a display device includes an output circuit for converting an image signal into a data signal in response to a clock signal, and providing the data signal to a plurality of data lines, and a clock generating and compensating circuit for receiving a main clock signal and generating the clock signal, wherein the clock generating and compensating circuit detects a slew rate of the data signal provided to at least one of the plurality of data lines, and adjusts a phase of the clock signal depending on the detected slew rate.

20 Claims, 10 Drawing Sheets

DISPLAY DEVICE HAVING CHARGING RATE COMPENSATING FUNCTION

CROSS-REFERENCE TO RELATED APPLICATION

This U.S. non-provisional patent application claims priority under 35 U.S.C. § 119 from Korean Patent Application No. 10-2017-0108222, filed on Aug. 25, 2017, the contents of which are incorporated by reference herein.

1. Technical Field

The present disclosure herein relates to a display device, and more particularly, to a display device which may compensate for the charging rate of a pixel.

2. Discussion of the Related Art

In general, a display device includes a display panel for displaying an image, and a driving circuit for driving the display panel. The display panel includes, for example, a plurality of gate lines, a plurality of data lines, and a plurality of pixels. Each of the pixels includes a switching transistor and a liquid crystal capacitor.

The display device may display an image by applying a gate-on voltage to the gate electrode of the switching transistor that is connected to a gate line for which the image is displayed, and then the display device applies a data signal corresponding to the image to the source electrode. As the switching transistor is turned on, the data signal applied to the liquid crystal capacitor should be maintained for a predetermined time even after the switching transistor is turned off.

Additionally, the charging rates of the plurality of pixels should be the same, but there is difficulty in maintaining uniform charging rates of the plurality of pixels. Differences in the charging rates of pixels can result a reduced quality of a display, for example, by the image having display stains.

SUMMARY

The inventive concept is directed to a display device and method of compensating a charging rate of a pixel.

An embodiment of the inventive concept provides a data driving circuit including: a clock generating and compensating circuit configured to receive a main clock signal MCLK and generate a clock signal CLK, an output circuit configured to convert an image signal into a data signal in response to the clock signal CLK, and provide the data signal to a plurality of data lines; and wherein the clock generating and compensating circuit is configured to detect a slew rate of the data signal provided to at least one data line of the plurality of data lines, and to adjust a phase of the clock signal CLK depending on the detected slew rate.

In an embodiment of the inventive concept, the clock generating and compensating circuit may advance the phase of the clock signal when the detected slew rate is lower than a reference level.

In an embodiment of the inventive concept, the clock generating and compensating circuit may include: a clock generator configured to receive the main clock signal, and generate a plurality of sub-clock signals having phases different from each other, a slew rate detector configured to compare the slew rate of the data signal provided to the at least one data line with a reference level, and output a detection signal, and a clock output circuit configured to output, in response to the detection signal, one of the plurality of sub-clock signals as the clock signal to compensate for the slew rate of the data signal.

In an embodiment of the inventive concept, the clock output circuit may further receive a vertical synchronization signal, and output a switching signal that is active for a predetermined time within a blanking interval of the vertical synchronization signal, and the slew rate detector may compare, in response to the switching signal, the slew rate of the data signal provided to the at least one data line with the reference level, and output the detection signal.

In an embodiment of the inventive concept, when the slew rate of the data signal is lower than the reference level, the clock output circuit may output a sub-clock signal, having a phase ahead of a phase of a current clock signal, of the plurality of sub-clock signals as the clock signal from a next frame, in response to the detection signal.

In an embodiment of the inventive concept, the slew rate detector may include: an integrator configured to accumulate the amount of current of the data signal provided to the at least one data line while the switching signal is active, and output an accumulation data signal, and a comparator configured to compare the accumulation data signal with a reference voltage, and output the detection signal.

In an embodiment of the inventive concept, when a voltage level of the accumulation data signal is lower than the reference voltage, the comparator outputs the detection signal having a high level, and when the voltage level of the accumulation data signal is higher than the reference voltage, the comparator outputs the detection signal having a low level.

In an embodiment of the inventive concept, the clock generating and compensating circuit may include: a clock generator configured to receive the main clock signal, and generate a plurality of sub-clock signals having phases different from each other, a slew rate detector configured to compare the slew rate of the data signal provided to the at least one data line with a reference level, and output a detection signal corresponding to a difference between the slew rate of the data signal and the reference level, and a clock output circuit configured to output a sub-clock signal, corresponding to the detection signal, of the plurality of sub-clock signals as the clock signal.

In an embodiment of the inventive concept, the slew rate detector may include: an integrator configured to accumulate the amount of current of the data signal provided to the at least one data line while the switching signal is active, and output an accumulation data signal, a comparator configured to compare the accumulation data signal with a reference voltage, and output a comparison signal having a pulse width corresponding to a difference between the accumulation data signal and the reference voltage, and an analog-to-digital converter configured to output the detection signal corresponding to the pulse width of the comparison signal.

In an embodiment of the inventive concept, the output circuit may include: a latch circuit configured to latch the image signal, and output the latched image signal in synchronization with the clock signal, a digital-to-analog converter configured to convert a digital image signal outputted from the latch circuit into an analog image signal, and an output buffer configured to output the analog image signal as the data signal in synchronization with the clock signal.

An embodiment of the inventive concept provides a display device including: a display panel having a plurality of pixels connected respectively to a plurality of gate lines and a plurality of data lines, a gate driving circuit configured to drive the plurality of gate lines, a data driving circuit configured to drive the plurality of data lines, and a drive controller configured to control the gate driving circuit and the data driving circuit in response to a control signal and an image input signal provided from the outside, and output an image signal corresponding to the image input signal, a vertical synchronization signal, and a main clock signal. The data driving circuit may include: an output circuit configured to convert the image signal into a data signal in response to a clock signal, and provide the data signal to the plurality of data lines, and a clock generating and compensating circuit configured to receive the main clock signal and the vertical synchronization signal, and generate the clock signal. The clock generating and compensating circuit may detect a slew rate of the data signal provided to at least one data line of the plurality of data lines, and adjust a phase of the clock signal depending on the detected slew rate.

In an embodiment of the inventive concept, the clock generating and compensating circuit may advance the phase of the clock signal when the detected slew rate is lower than a reference level.

In an embodiment of the inventive concept, the clock generating and compensating circuit may include: a clock generator configured to receive the main clock signal, and generate a plurality of sub-clock signals having phases different from each other, a slew rate detector configured to compare the slew rate of the data signal provided to the at least one data line with a reference level, and output a detection signal; and a clock output circuit configured to output, in response to the detection signal, one of the plurality of sub-clock signals as the clock signal.

In an embodiment of the inventive concept, the drive controller may output the main clock signal for a predetermined time within a blanking interval of the vertical synchronization signal. The clock output circuit may output a switching signal that is active for a predetermined time within the blanking interval of the vertical synchronization signal. The slew rate detector may compare, in response to the switching signal, the slew rate of the data signal provided to the at least one data line with the reference level, and output the detection signal.

In an embodiment of the inventive concept, the clock output circuit may output a sub-clock signal, having a phase ahead of a phase of a current clock signal, of the plurality of sub-clock signals as the clock signal from a next frame, in response to the detection signal.

In an embodiment of the inventive concept, the slew rate detector may include: an integrator configured to accumulate the amount of current of the data signal provided to the at least one data line while the switching signal is active, and output an accumulation data signal, and a comparator configured to compare the accumulation data signal with a reference voltage, and output the detection signal.

In an embodiment of the inventive concept, the clock generating and compensating circuit may include: a clock generator configured to receive the main clock signal, and generate a plurality of sub-clock signals having phases different from each other, a slew rate detector configured to compare the slew rate of the data signal provided to the at least one data line with a reference level, and output a detection signal corresponding to a difference between the slew rate of the data signal and the reference level, and a clock output circuit configured to output a sub-clock signal, corresponding to the detection signal, of the plurality of sub-clock signals as the clock signal.

In an embodiment of the inventive concept, the slew rate detector may include: an integrator configured to accumulate the amount of current of the data signal provided to the at least one data line while the switching signal is active, and output an accumulation data signal, a comparator configured to compare the accumulation data signal with a reference voltage, and output a comparison signal having a pulse width corresponding to a difference between the accumulation data signal and the reference voltage, and an analog-to-digital converter configured to output the detection signal corresponding to the pulse width of the comparison signal.

In an embodiment of the inventive concept, the output circuit may include: a latch circuit configured to latch the image signal, and output the latched image signal in synchronization with the clock signal, a digital-to-analog converter configured to convert a digital signal outputted from the latch circuit into an analog signal, and an output buffer configured to output the analog signal as the data signal in synchronization with the clock signal.

In an embodiment of the inventive concept, a method of detecting and compensating for a slew rate of a data in a data driving circuit, the method includes: receiving, by a clock generating and compensating circuit, a main clock signal (MCLK) and generating the clock signal (CLK), converting, by an output circuit, an image signal into a data signal in response to receiving the clock signal (CLK), and providing the data signal to a plurality of data lines; and detecting, by the clock generating and compensating circuit, a slew rate of the data signal provided to at least one data line of the plurality of data lines, and adjusting a phase of the clock signal (CLK) depending on the detected slew rate, wherein the adjusting of the phase of the clock signal includes advancing, by the clock generating and compensating circuit, the phase of the clock signal when the detected slew rate is lower than a reference level.

BRIEF DESCRIPTION OF THE DRAWINGS

The accompanying drawings are included to provide a further understanding of the inventive concept, and are incorporated in and constitute a part of this specification. The drawings illustrate some embodiments of the inventive concept and, together with the description, serve to describe principles of the inventive concept. In the drawings.

DETAILED DESCRIPTION

Figure 1:
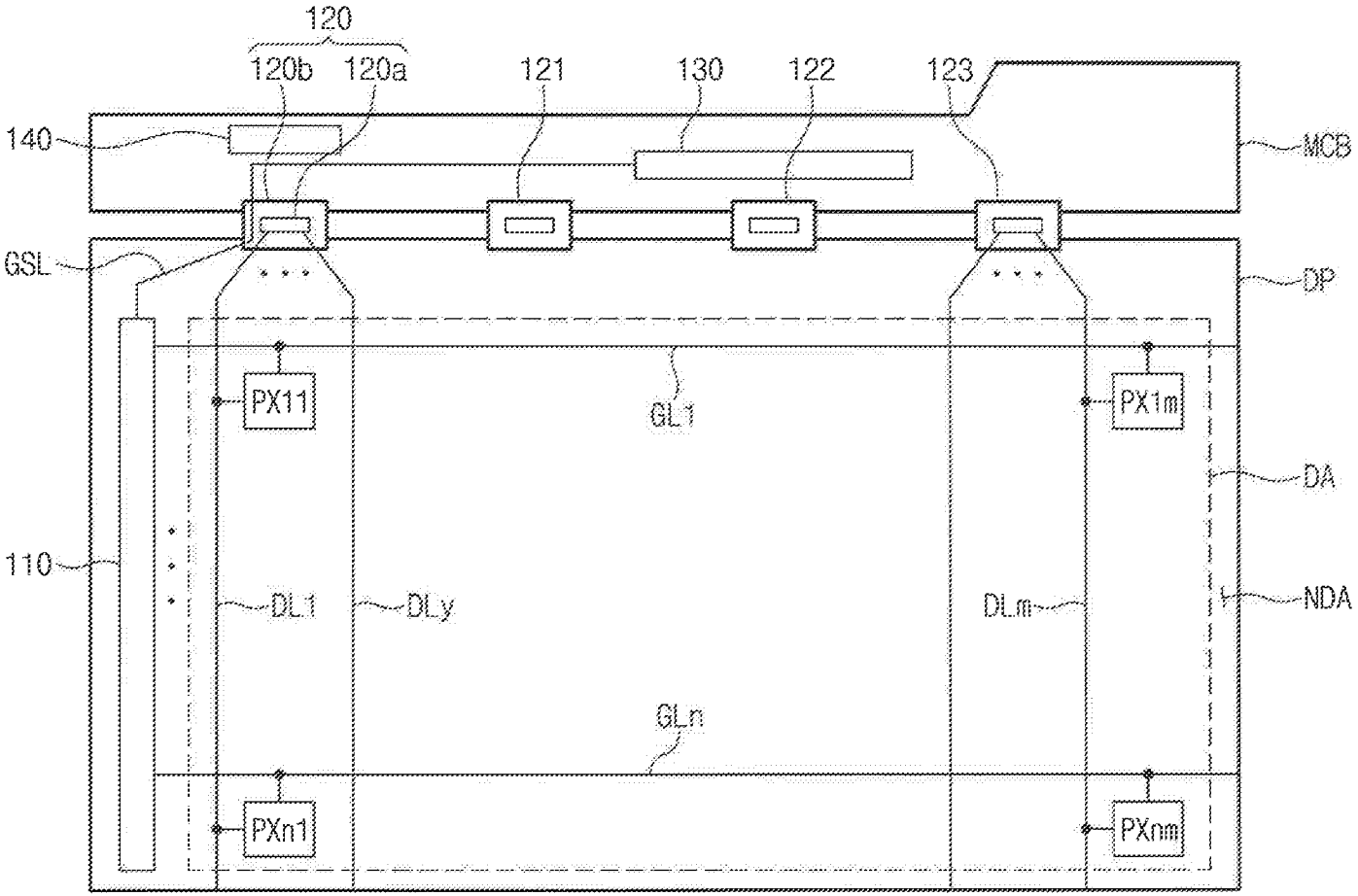
FIG. 1 is a plan view illustrating a display device according to an embodiment of the inventive concept.

Hereinafter, embodiments of the inventive concept are described in more detail with reference to the accompanying drawings.

In the description below, like reference numerals may be used to refer to like parts, components, blocks, circuits, units or modules that have the same or similar function, throughout two or more figures. Such description, however, is provided only for the sake of ease of description. The description of the inventive concept herein does not mean that the configuration or structural details of such components or units are the same in all embodiments, and/or that the parts/modules jointly referred to are the only way to implement the teachings of the specific embodiments disclosed herein.

Figure 2:
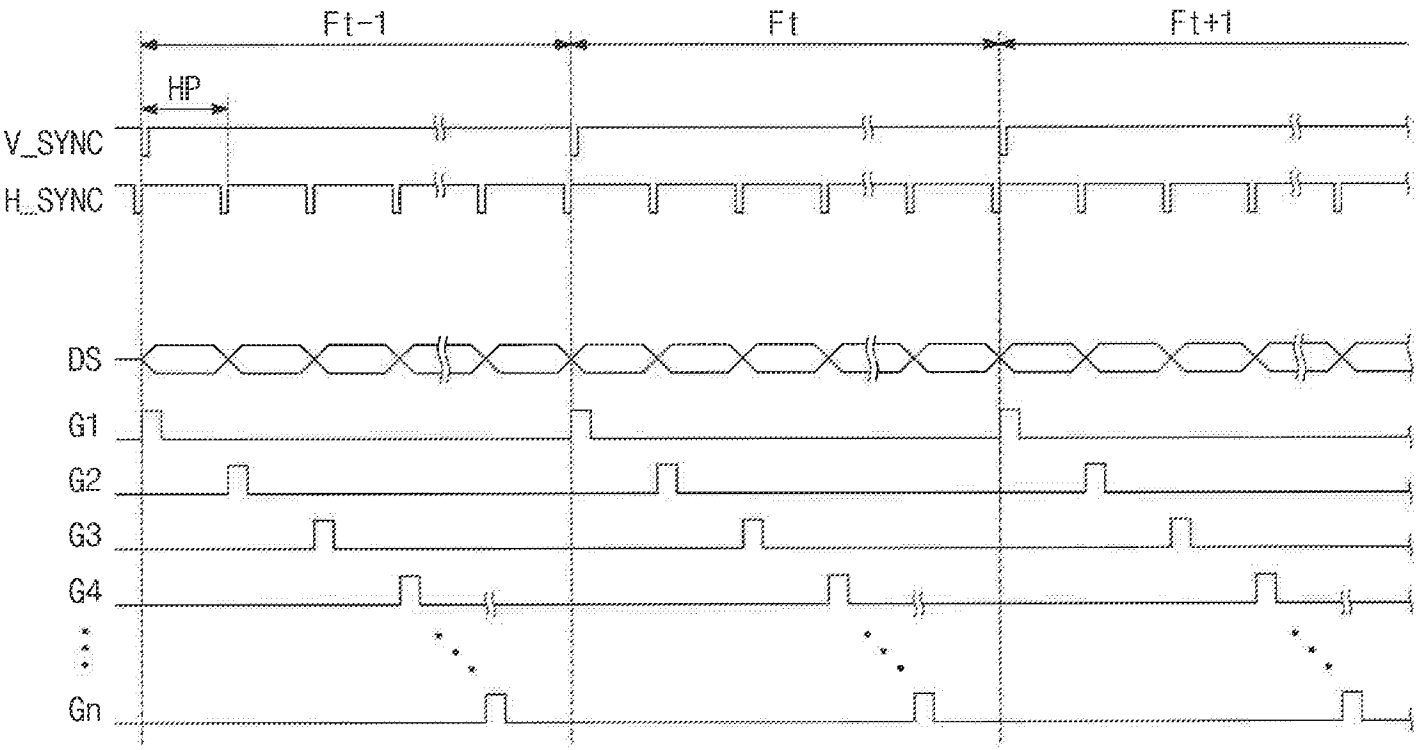
FIG. 2 is a timing diagram illustrating signals of a display device according to an embodiment of the inventive concept.

FIG. 1 is a plan view illustrating a display device according to an embodiment of the inventive concept. FIG. 2, is a timing diagram illustrating signals of a display device according to an embodiment of the inventive concept.

Referring now to FIGS. 1 and 2, the display device according to an embodiment of the inventive concept includes a display panel DP, a gate driving circuit 110, data driving circuits 120 to 123, a drive controller 130, and a voltage generator 140.

The display panel DP is not particularly limited, but may include various display panels such as a liquid crystal display panel, an organic light emitting display panel, an electrophoretic display panel, and an electrowetting display panel. The display panel may be rectangularly-shaped with two long sides and two short sides, with the gate driving circuit arranged along one of the two short sides of the rectangularly-shaped display panel.

When viewed in a plan view, the display panel DP includes a display area DA in which a plurality of pixels PX11 to PXnm are arranged, and a non-display area NDA which encloses the display area DA. On the side where the display area is arranged, the non-display area is smaller than the display area DA.

According to an embodiment of the inventive concept, the display panel DP includes a plurality of gate lines GL1 to GLn, and a plurality of data lines DL1 to DLm crossing the gate lines GL1 to GLn in a substantially perpendicular arrangement. The plurality of gate lines GL1 to GLn are connected to the gate driving circuit 110. The plurality of data lines DL1 to DLm are connected to the data driving circuits 120, 121, 122 and 123. In this embodiment, each of the data driving circuits 120 to 123 is assumed to be connected to a particular number (e.g., y number) of data lines (where, each of y, m, and n is a positive integer, and m is greater than y.). Illustrated in FIG. 1 are only some of the plurality of gate lines GL1 to GLn and some of the plurality of data lines DL1 to DLm. However, the inventive concept is much broader than the embodiment shown and described in FIG. 1 and FIG. 2.

In FIG. 1, a person of ordinary skill in the art should understand and appreciate that only some of the plurality of pixels PX11 to PXnm are illustrated, so as not to obscure appreciation of the inventive concept with redundant items. Each of the plurality of pixels PX11 to PXnm is connected to a corresponding gate line of the plurality of gate lines GL1 to GLn and to a corresponding data line of the plurality of data lines DL1 to DLm.

The plurality of pixels PX11 to PXnm may be divided into a plurality of groups according to a color to be displayed. For example, the plurality of pixels PX11 to PXnm may display one of primary colors. The primary colors may include red, green, blue, and white. The primary colors, however, are not limited thereto, and may further include various colors such as yellow, cyan, and magenta.

With continued reference to FIGS. 1 and 2, the gate driving circuit 110 and the data driving circuits 120 to 123 receive a control signal from the drive controller 130. The drive controller 130 may include integrated circuitry configured for operation. While the drive controller 130 may be mounted on a main circuit board MCB, the inventive concept is not limited to such a construction. For example, the drive controller 130 may be mounted on another circuit board that is connected electrically to the main circuit board MCB. The drive controller 130 receives image data and the control signal from an external device, for example, a graphic control unit (not illustrated). The control signal may include: a vertical synchronization signal V_SYNC which is a distinction signal for frame periods Ft−1, Ft, and Ft+1; a horizontal synchronization signal H_SYNC which is a distinction signal for horizontal periods HP, e.g., a row distinction signal; a data enable signal having a high level only for a time period when data are outputted and may indicate a zone in which the data come in; and clock signals.

With particular reference to FIG. 2, the gate driving circuit 110 generates gate signals G1 to Gn on the basis of a gate control signal received via a signal line GSL from the drive controller 130, and outputs the gate signals G1 to Gn to the plurality of gate lines GL1 to GLn, during the frame periods Ft−1, Ft, and Ft+1. The gate signals G1 to Gn are sequentially activated during each of the frame periods Ft−1, Ft, and Ft+1.

In addition, the gate driving circuit 110 may be formed simultaneously with the pixels PX11 to PXnm through a thin film process. For example, the gate driving circuit 110 may be mounted in the non-display area NDA as an oxide semiconductor TFT gate driver circuit (OSG). In another embodiment of the inventive concept, the gate driving circuit 110 may include a driving chip (not illustrated), and a flexible circuit board (not illustrated) on which the driving chip is mounted. In this case, the flexible circuit board may be electrically connected to the main circuit board MCB. In another embodiment of the inventive concept, the gate driving circuit 110 may be disposed in the non-display area NDA of the display panel DP by a chip on glass (COG) technique.

FIG. 1 illustrates, by way of example, that one gate driving circuit 110 connected to left ends of the plurality of gate lines GL1 to GLn. In another embodiment of the inventive concept, the display device may include two or more gate driving circuits. If there are, for example, just two gate driving circuits, then one of the two gate driving circuits may be connected to left ends of the plurality of gate lines GL1 to GLn, and the other may be connected to right ends of the plurality of gate lines GL1 to GLn. Alternatively, one of the two gate driving circuits may be connected to odd-numbered gate lines, and the other may be connected to even-numbered gate lines. In another alternative, one the of the gate driving circuits may be connected to a first group of gates lines in succession (e.g., first half) and another of the gate driving circuits may be connected to a second group of gates lines in succession (e.g., second half).

The data driving circuits 120 to 123 may generate gradation voltages depending on the image data provided from the drive controller 130, on the basis of a data control signal received from the drive controller 130. The data driving circuits 120 to 123 output the gradation voltages to the plurality of data lines DL1 to DLm as data signals DS.

The data signals DS may include positive data signals having positive values with reference to a common voltage, and/or negative data signals having negative values. Some of the data signals applied to the data lines DL1 to DLm during each of the horizontal periods HP may have positive polarity, and the rest may have negative polarity. Polarity of the data signals may be inverted for each frame period as one possible way to prevent degradation of a liquid crystal. The data driving circuits 120 to 123 may generate inverted data signals by frame period in response to an inversion signal.

Each of the data driving circuits 120 to 123 may include a driving chip 120*a*, and a circuit board that may be a flexible circuit board 120*b* on which the driving chip 120*a* is mounted. As shown in FIG. 1 the flexible circuit board 120*b* electrically connects the main circuit board MCB and the display panel DP. The plurality of the driving chips 120*a* respectively provide corresponding data signals to corresponding data lines of the plurality of data lines DL1 to DLm.

FIG. 1 illustrates, by way of example, data driving circuits 120 to 123 of a chip on film (COF) type. In another embodiment of the inventive concept, the data driving circuits 120 to 123 may not be arranged on the Main Circuit Board, and for example, may be arranged in the non-display area NDA of the display panel DP by a chip on glass (COG) technique. A person of ordinary skill in the art should understand that the inventive concept is not limited to the aforementioned arrangements.

Each of the plurality of pixels PX11 to PXnm includes a thin film transistor and a liquid crystal capacitor. Each of the plurality of pixels PX11 to PXnm may further include a storage capacitor.

A pixel PXij is electrically connected to an i-th gate line GLi and a j-th data line DLj. The pixel PXij outputs a pixel image corresponding to a data signal received from the j-th data line DLj, in response to a gate signal G1 received from the i-th gate line GLi.

Figure 6:
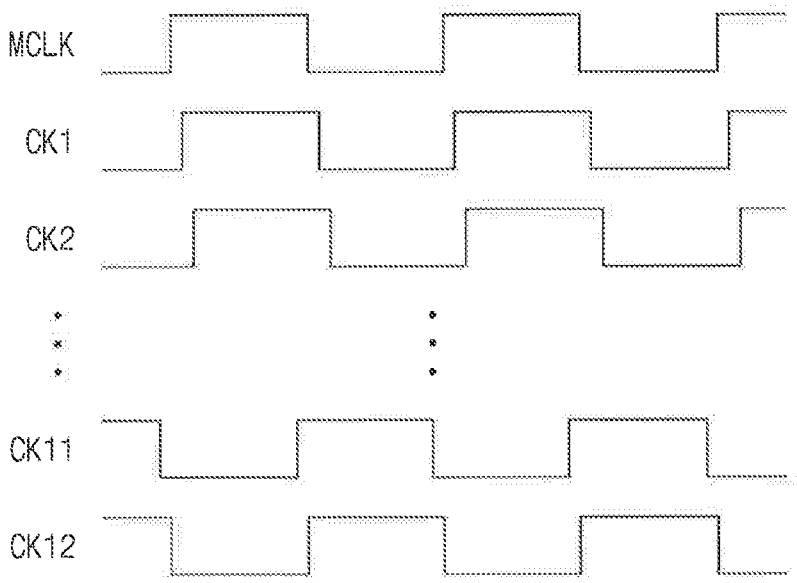
FIG. 6 is a timing diagram illustrating, by way of example, a plurality of clocks generated in the clock generating and compensating circuit illustrated in FIG. 5.

The voltage generator 140 may generate various voltages that may be provided to the gate driving circuit 110, the data driving circuits 120 to 123, and the drive controller 130. While FIG. 6 shows the voltage generator mounted on the main circuit board, the inventive concept is not limited to this arrangement and the voltage generator may be mounted within the display device.

The voltage generator 140 may generate a gate-on voltage and a gate-off voltage for the operation of the gate driving circuit 110. The gate-on voltage may be a relatively high voltage (for example, about 40 V), and thus the temperature of the voltage generator 140 generating multiple voltages may rise.

Slew rates of the data signals that the data driving circuits 120 to 123 provide to the data lines DL1 to DLm may be affected by an ambient temperature. Ambient temperatures differ between the data driving circuit 120 adjacent to the voltage generator 140 and the data driving circuit 123 far from the voltage generator 140, among the data driving circuits 120 to 123.

While FIG. 1 only shows four data driving circuits, the inventive concept is not limited to this quantity. In the event there are more than four driving circuits, the distance from the voltage generator would typically increase if their arrangement is consistent with FIG. 1, and the temperature difference between the data driving circuit 120 that is closest to the voltage generator (from among the data driving circuits) may have a more pronounced difference in ambient temperature versus the data driving circuit furthest away from the voltage generator.

Figure 3:
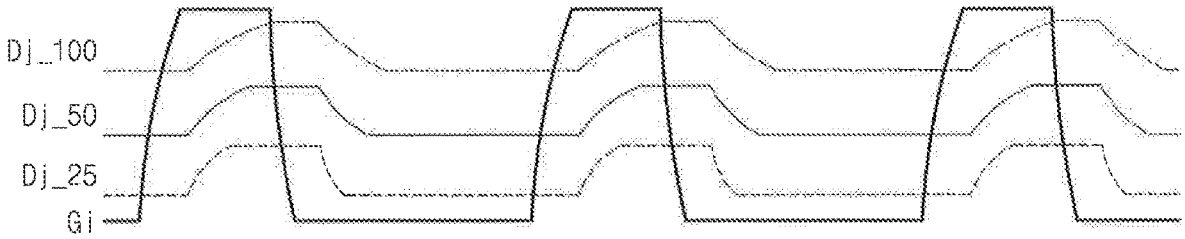
FIG. 3 illustrates, by way of example, changes of a slew rate, depending on an ambient temperature, of a data signal provided to a data line.

FIG. 3 illustrates, by way of example, changes of the slew rate, depending on an ambient temperature, of a data signal provided to a data line.

Referring to FIGS. 1 and 3, a slew rate of a data signal Dj provided to the j-th data line of the data lines DL1 to DLm may be affected by an ambient temperature. Moreover, at different ambient temperatures, the slew rate of the data signal may change. For example, a slew rate of a data signal Dj_100 when an ambient temperature is 100 degrees is lower than that of a data signal Dj_25 when an ambient temperature is 25 degrees. It can be seen in FIG. 3 that the data signal Dj_100 is more sloped than the other data signals shown.

As described above, when each of the data driving circuits 120 to 123 has a different ambient temperature, the slew rates of data signals outputted from the data driving circuits 120 to 123 may differ. In this case, there may appear a display stain due to a difference in charging rates of the pixels. Thus, image quality of the display device may suffer.

Figure 4:
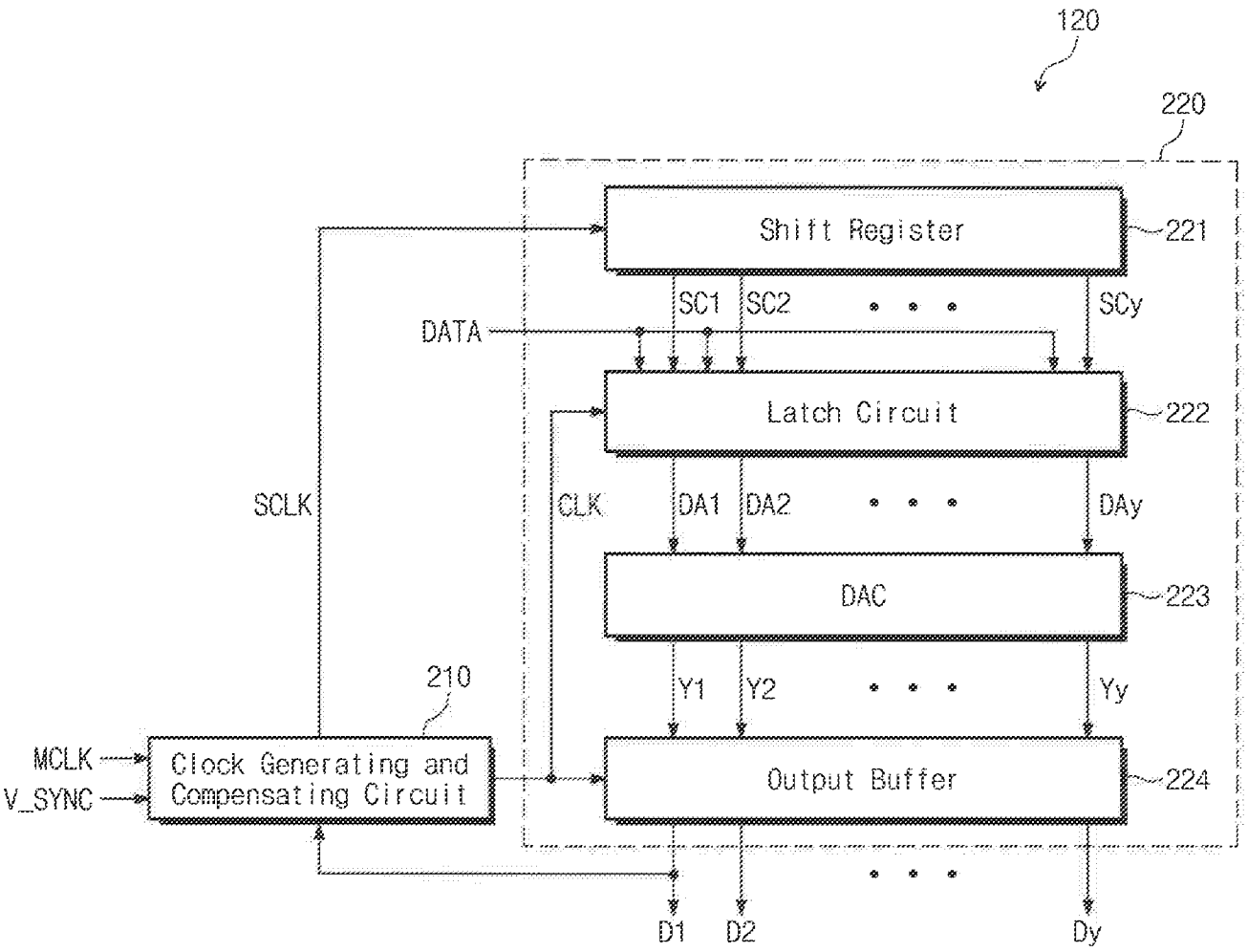
FIG. 4 is a block diagram illustrating a configuration of a data driving circuit according to an embodiment of the inventive concept.

FIG. 4 is a block diagram illustrating a configuration of the data driving circuit according to an embodiment of the inventive concept. The data driving circuit in FIG. 4 has a construction that can reduce or prevent a display stain from occurring because of the effects of different slew rates of a plurality of driving circuits (e.g., data driving circuits 120-123) on the charging rates of the pixels.

Referring to FIG. 4, the data driving circuit 120 includes a clock generating and compensating circuit 210 and an output circuit 220. In FIG. 4, only the data driving circuit 120 is illustrated from among the plurality of data driving circuits 120 to 123 illustrated in FIG. 1, but other data driving circuits 121 to 123 may also include the same or similar configurations as the data driving circuit 120.

The clock generating and compensating circuit 210 receives a main clock signal MCLK and the vertical synchronization signal V_SYNC from the drive controller 130 illustrated in FIG. 1, and generates clock signals SCLK and CLK. The SCLK signal generated by the clock generating and compensating circuit 210 is provided to a shift register 221 of the output circuit 220, and the CLK signal is provided to a latch circuit 222 and an output buffer 224.

The output circuit 220 converts, in response to the clock signals SCLK and CLK provided from the clock generating and compensating circuit 210, a data signal DATA from the drive controller 130 illustrated in FIG. 1 into data signals D1 to Dy, and provides the data signals D1 to Dy to the data lines DL1 to DLy illustrated in FIG. 1.

The output circuit 220 may include a shift register 221, a latch circuit 222, a digital-to-analog converter 223, and an output buffer 224. The shift register 221 sequentially activates latch clock signals SC1 to SCy in synchronization with the clock signal SCLK. The latch circuit 222 latches the data signal DATA in synchronization with the latch clock signals SC1 to SCy from the shift register 221, and provides digital image signals DA1 to DAy to the digital-to-analog converter 223 in response to the clock signal CLK.

The digital-to-analog converter 223 outputs, to the output buffer 224, the digital image signals DA1 to DAy from the latch circuit 222, as analog image signals Y1 to Yy. The output buffer 224 receives the analog image signals Y1 to Yy from the digital-to-analog converter 223, and outputs the data signals D1 to Dy to the data lines DL1 to DLy illustrated in FIG. 1 in response to a line latch signal LOAD.

The clock generating and compensating circuit 210 detects a slew rate of a data signal (in this embodiment, the data signal D1 from the data line DL1) from any one of the data lines DL1 to DLy, and adjusts a phase of the clock signal CLK depending on the detected slew rate.

For example, when a slew rate of the data signal D1 is lower than a reference level, the phase of the clock signal CLK is advanced. When the phase of the clock signal CLK is advanced, output points of time of the data signals D1 to Dy outputted from the output buffer 224 are advanced. When slew rates of the data signals D1 to Dy have become lower due to a change in ambient temperature or the like, the charging rates of the pixels may be compensated for by advancing the output points of time of the data signals D1 to Dy.

In addition, each of the data driving circuits 120 to 123 illustrated in FIG. 1 may separately adjust a phase of an internal clock signal CLK depending on a slew rate of a data signal outputted therefrom. As discussed herein above, in one possibility, the voltage generator 140 cause the ambient temperature to change, and the relatively closer each driving circuit is arranged relative to the voltage generator 140 the higher may be the ambient temperature of the driving circuit. Accordingly, when ambient temperatures of the data driving circuits 120 to 123 are different from each other, each of the data driving circuits 120 to 123 may have a clock generating and compensating circuit that outputs a clock signal CLK having an optimal phase (e.g., an optimally adjusted phase). In turn, the optimally adjusted phase of the CLK signal uses the output points of time of the data signals D1 to Dy from the output buffer are advanced. This advancement of the output points provides compensation of the charging rate of the pixels.

In an embodiment of the inventive concept, there may be a lookup table (not shown) that stores slew rates of each of the data driving circuits and an associated amount of advancement of a phase of a respective clock signal for each of the data driving circuits, and the clock generating and compensating circuit may be configured to retrieve from the lookup table a value that the phase of the respective clock signal is to be advanced.

For example, the lookup table may stores slew rates and the associated amount of advancement of the phase of the respective clock signal for each of the data driving circuits based on an ambient temperature of each of the data driving circuits. Thus, the display device according to an embodiment of the inventive concept may include temperature sensors obtain ambient temperature readings of the plurality of driving circuits. In an embodiment, of the inventive concept, the ambient temperature of the driving circuits is related to its distance from the voltage generator 140, as the voltage generator 140 generates heat that may cause the ambient temperature of the driving circuits relatively close thereto to be higher than the driving circuits relatively further away from the voltage generator 140. Thus, the lookup table may store typical phase advancements for respective driving circuits at various ambient temperatures.

Figure 5:
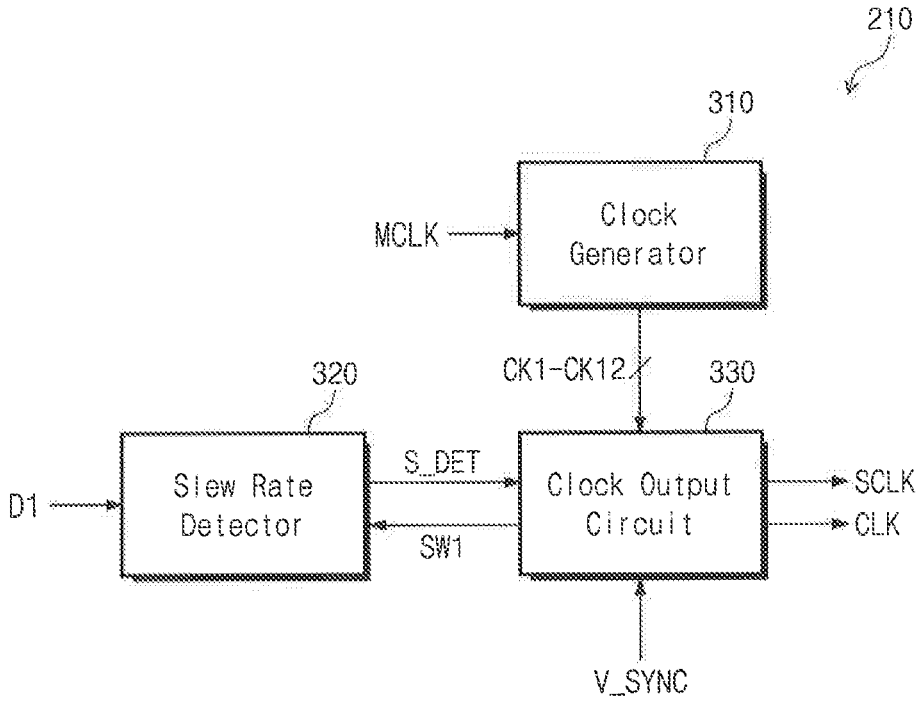
FIG. 5 is a block diagram illustrating a configuration of a clock generating and compensating circuit according to an embodiment of the inventive concept.

FIG. 5 is a block diagram illustrating a configuration of the clock generating and compensating circuit according to an embodiment of the inventive concept. FIG. 6 is a timing diagram illustrating, by way of example, a plurality of clocks generated in the clock generating and compensating circuit illustrated in FIG. 5.

Referring to FIG. 5, the clock generating and compensating circuit 210 may include a clock generator 310, a slew rate detector 320, and a clock output circuit 330.

The clock generator 310, which may be comprised of an integrated circuit, and/or may part of a microprocessor, receives the main clock signal MCLK and generates sub-clock signals CK1 to CK12 (in this example) having phases that are different from each other. The clock generator may be a multiphase clock that is capable of multiple outputs at various phases. In FIGS. 5 and 6, the clock generator 310 generates the 12 sub-clock signals CK1 to CK12, but the number of the sub-clock signals may vary widely (more than 12 clock sub-signals or less than 12 sub-clock signals). The slew rate detector 320 compares, with the reference level, a slew rate of a data signal provided to any one of the plurality of data lines DL1 to DLy illustrated in FIG. 1, and outputs a detection signal S_DET. In an embodiment of the inventive concept, the slew rate detector 320 receives the data signal D1 of the data line DL1. However, for example, the slew rate detector 320 may receive the data signal D6 of data line DL6, or data signal DY of the data line DLy.

The clock output circuit 330 receives the sub-clock signals CK1 to CK12, and outputs the clock signals SCLK and CLK in response to the detection signal S_DET and the vertical synchronization signal V_SYNC. The clock output circuit 330 outputs one of the sub-clock signals CK1 to CK12 as the clock signal CLK on the basis of the detection signal S_DET. Additionally, the clock output circuit 330 may further output a switching signal SW1 in response to the vertical synchronization signal V_SYNC. The clock output circuit 330 activates the switching signal SW1 at a first level (for example, a high level) for a predetermined time within a blanking interval of the vertical synchronization signal V_SYNC. The slew rate detector 320 may compare the slew rate of the data signal D1 with the reference level in response to the switching signal SW1, and output the detection signal S_DET.

Figure 7:
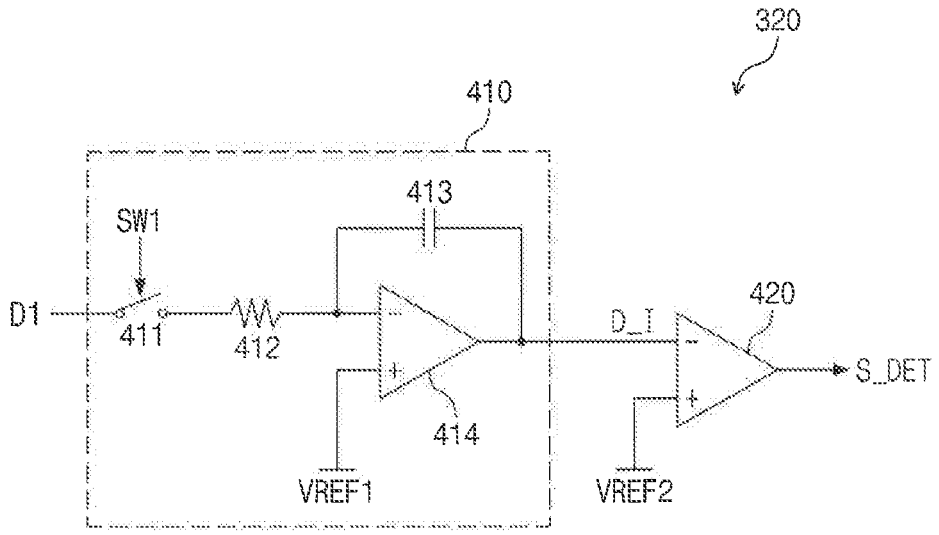
FIG. 7 illustrates a configuration of a slew rate detector according to an embodiment of the inventive concept.

FIG. 7 illustrates a hardware configuration of the slew rate detector according to an embodiment of the inventive concept.

Referring now to FIG. 7, the slew rate detector 320 may include an integrator 410 and a comparator 420. The integrator 410 accumulates the amount of current of the data signal D1 provided to the data line DL1 while the switching signal SW1 from the clock output circuit 330 illustrated in FIG. 5 is active, and outputs an accumulation data signal D_I.

The integrator 410 includes a switch 411, a resistor 412, a capacitor 413, and an amplifier 414. The switch 411 may be turned on in response to the switching signal SW1. For example, the switch 411 is turned on when the switching signal SW1 becomes activated at the first level (for example, the high level). In an embodiment of FIG. 7, a reference voltage VREF1 is connected to a non-inverting input terminal (+) of the amplifier 414, but in another embodiment, a ground voltage may be connected to the non-inverting input terminal (+) of the amplifier 414.

The integrator 410 accumulates the data signal D1 while the switching signal SW1 is active at the first level (for example, the high level), and outputs the accumulation data signal D_I.

The comparator 420 compares the accumulation data signal D_I with a reference voltage VREF2, and outputs the detection signal S_DET. For example, when a voltage level of the accumulation data signal D_I is lower than the reference voltage VREF2, the comparator 420 outputs a detection signal S_DET of a high level, and when the voltage level of the accumulation data signal D_I is higher than the reference voltage VREF2, the comparator 420 outputs a detection signal S_DET of a low level. The voltage level of the reference voltage VREF2 may be a reference level for determining whether the slew rate of the data signal D1 is sufficiently high. When the voltage level of the accumulation data signal D_I, corresponding to the slew rate of the data signal D1, is lower than a reference level, e.g., the reference voltage VREF2, the slew rate of the data signal D1 may be compensated for, e.g., with one way as discussed herein above.

Figure 8:
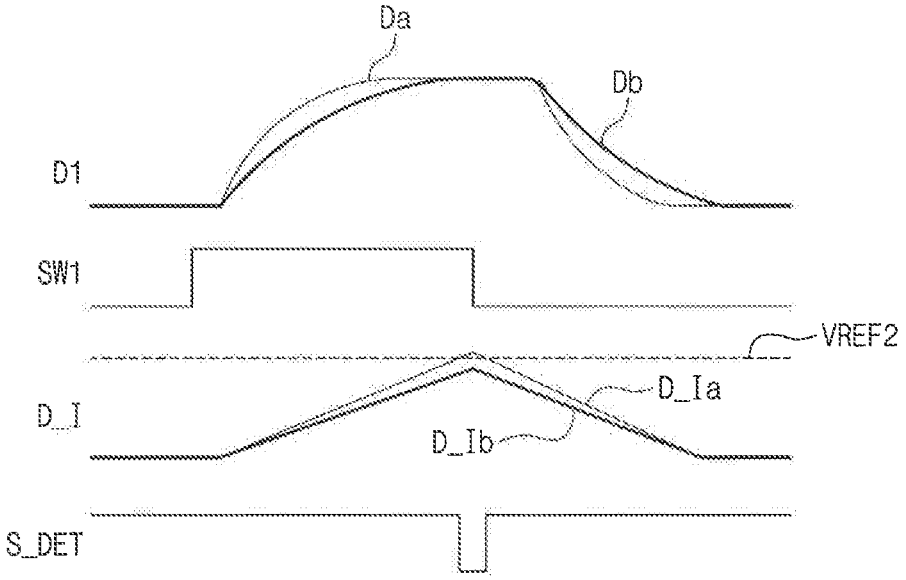
FIG. 8 illustrates a process of generating a detection signal when a slew rate is lower than a reference level in the slew rate detector illustrated in FIG. 7.

FIG. 8 illustrates, according to a current curve of the data signal, a process of generating the detection signal when a slew rate is lower than the reference level in the slew rate detector such as illustrated in FIG. 7.

Referring to FIGS. 7 and 8, according to an embodiment of the inventive concept, when the data signal D1 transmitted through the data line DL1 has, for example, a slew rate as in a current curve Da, an accumulation data signal D_Ia outputted through the integrator 410 may be a voltage level higher than the reference voltage VREF2. The detection signal S_DET is outputted as a low level at the time when the accumulation data signal D_Ia becomes a voltage level higher than the reference voltage VREF2.

On the other hand, when the data signal D1 transmitted through the data line DL1 has a slew rate as in a current curve Db, an accumulation data signal D_Ib outputted through the integrator 410 remains at voltage levels lower than the reference voltage VREF2, causing the detection signal S_DET to be kept at a high level.

Accordingly, when the slew rate of the data signal D1 is sufficiently high (for example, in the case of the current curve Da), the detection signal S_DET is outputted as a low level. When the slew rate of the data signal D1 is low (for example, in the case of the current curve Db), the detection signal S_DET is maintained at a high level. Compensation may be performed when the slew rate of the data signal D1 is low.

The clock output circuit 330 illustrated in FIG. 5 keeps the clock signal CLK unchanged when the detection signal S_DET received during the blanking interval of the vertical synchronization signal V_SYNC is at a low level at any one time. When the detection signal S_DET remains at a high level during the blanking interval of the vertical synchronization signal V_SYNC, the clock output circuit 330 outputs a sub-clock signal, having a phase ahead of that of a clock signal CLK of a current frame, of the sub-clock signals CK1 to CK12 as a clock signal CLK of a next frame.

Figure 9:
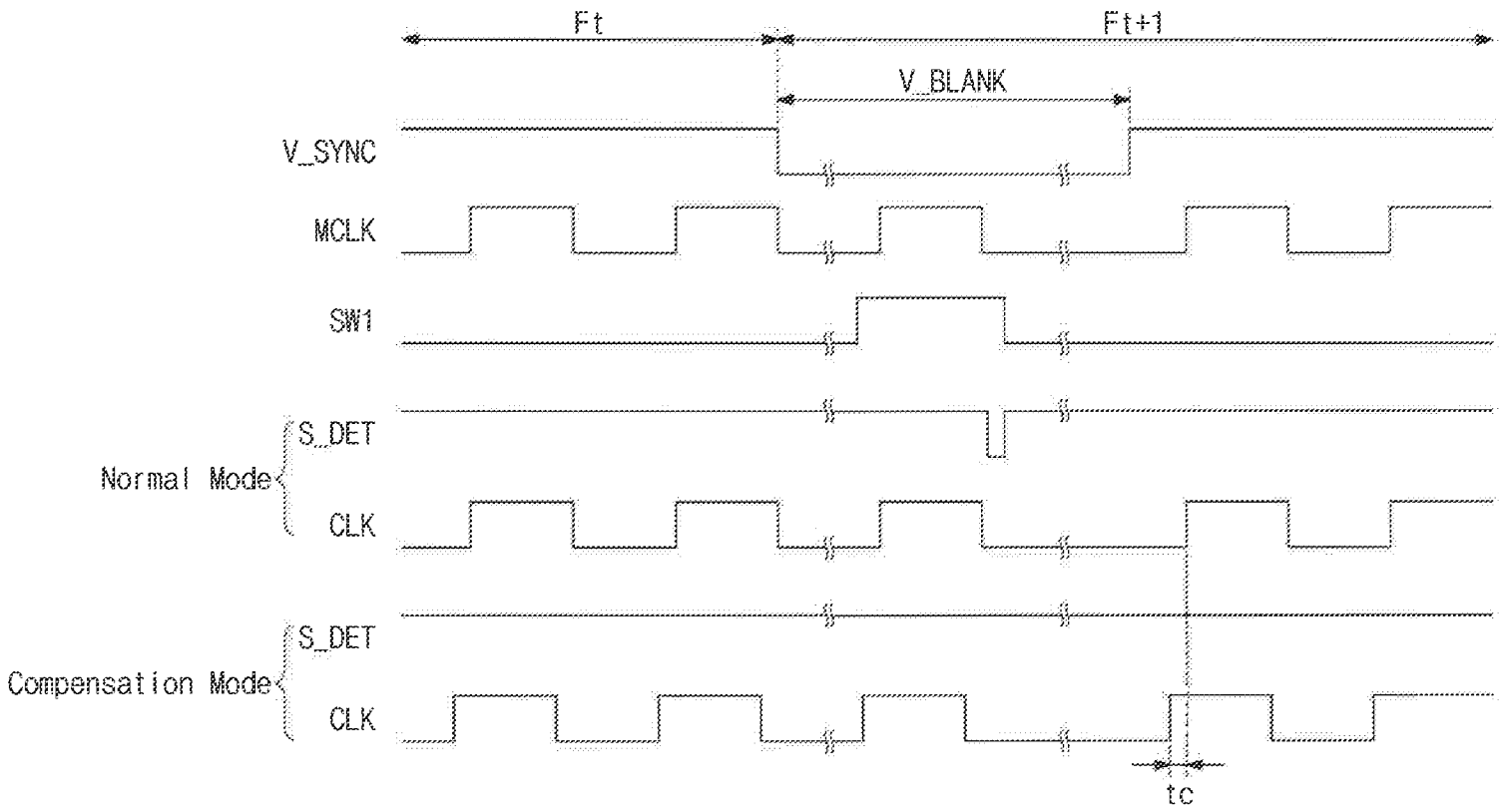
FIG. 9 is a timing diagram illustrating an operation of the clock generating and compensating circuit illustrated in FIG. 5 during a vertical blanking interval.

FIG. 9 is a timing diagram illustrating an operation of the clock generating and compensating circuit illustrated in FIG. 5 during a vertical blanking interval.

Referring to FIGS. 5 and 9, the clock signal CLK, in general, may be kept at a low level during a blanking interval V_BLANK. In this embodiment, the drive controller 130 illustrated in FIG. 1 provides the main clock signal MCLK and a test data signal DATA to the data driving circuits 120 to 123 for a predetermined time during the blanking interval V_BLANK of the vertical synchronization signal V_SYNC.

The clock generator 310 receives the main clock signal MCLK, and generates the sub-clock signals CK1 to CK12 having phases different from each other. The clock output circuit 330 activates the switching signal SW1 at the high level for a predetermined time within the blanking interval V_BLANK of the vertical synchronization signal V_SYNC.

The slew rate detector 320 accumulates the data signal D1 while the switching signal SW1 is at the high level, and then, when a voltage level of the accumulation data signal D_I is lower than the reference voltage VREF2, the comparator 420 (FIG. 7) outputs a detection signal S_DET of a high level, and when the voltage level of the accumulation data signal D_I is higher than the reference voltage VREF2, the comparator 420 outputs a detection signal S_DET of a low level.

The clock output circuit 330 keeps the clock signal CLK unchanged when the detection signal S_DET received during the blanking interval V_BLANK of the vertical synchronization signal V_SYNC is at a low level at any one time. Accordingly, the clock output circuit 330 operates in a normal mode when the detection signal S_DET during the blanking interval V_BLANK is at a low level at any one time.

When the detection signal S_DET is kept at a high level during the blanking interval V_BLANK of the vertical synchronization signal V_SYNC, the clock output circuit 330 outputs a sub-clock signal, having a phase ahead of that of a clock signal CLK of a current frame Ft, of the sub-clock signals CK1 to CK12 as a clock signal CLK of a next frame Ft+1. Accordingly, the clock output circuit 330 operates in a compensation mode when the detection signal S_DET during the blanking interval V_BLANK is kept at a high level.

For example, with reference to FIG. 6, when the clock output circuit 330 has outputted the sub-clock signal CK12 illustrated in FIG. 6 as the clock signal CLK during the current frame Ft, the sub-clock signal CK11 having a phase ahead of that of the sub-clock signal CK12 is outputted as the clock signal CLK during the next frame Ft+1. In another embodiment, the clock output circuit 330 may output, as the clock signal CLK, any one of the sub-clock signals CK1 to CK10 having phases ahead of that of the sub-clock signal CK12.

Referring now to FIG. 9, in the compensation mode, where the detection signal S_DET is maintained at a high level during the blanking interval of the vertical synchronization signal V_SYNC, the output points of time of the data signals D1 to Dy outputted from the output buffer 224 illustrated in FIG. 4 are advanced according as the phase of the clock signal CLK is advanced by a predetermined time tc. When the slew rates of the data signals D1 to Dy have become lower, the charging rates of the pixels may be compensated for by advancing the output points of time of the data signals D1 to Dy.

Figure 10:
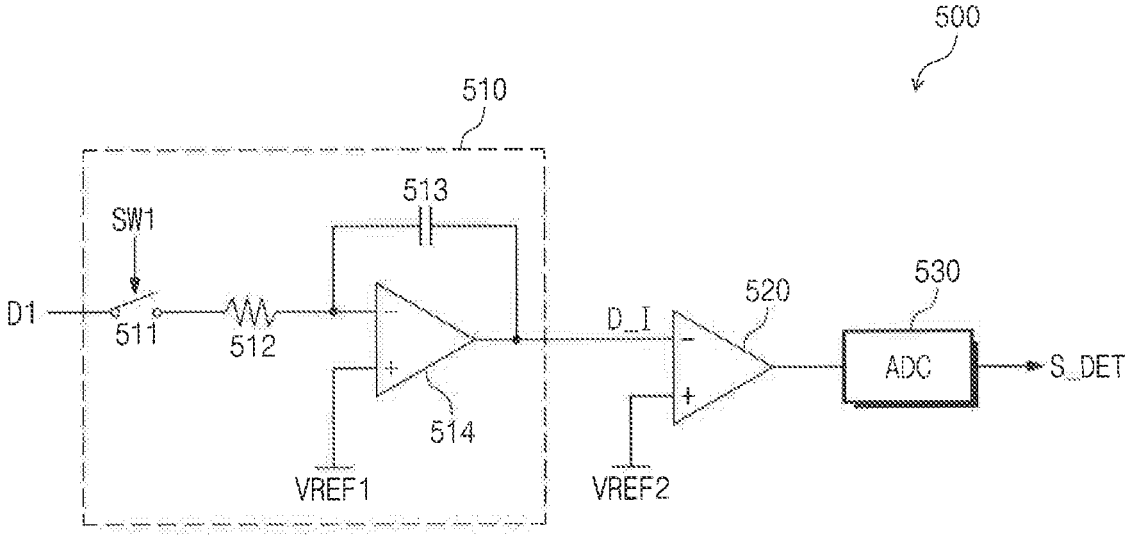
FIG. 10 illustrates a configuration of a slew rate detector according to another embodiment of the inventive concept.

FIG. 10 illustrates a configuration of a slew rate detector according to another embodiment of the inventive concept.

Referring to FIG. 10, a slew rate detector 500 includes an integrator 510, a comparator 520, and an analog-to-digital converter 530. The integrator 510 and the comparator 520 have substantially the same configurations and operate in substantially the same ways as the integrator 410 and the comparator 420 illustrated in FIG. 7, and thus duplicate descriptions will not be given. The analog-to-digital converter 530 converts a signal outputted from the comparator 520 into a detection signal S_DET that is a digital signal. For example, the analog-to-digital converter 530 may output a detection signal S_DET having a digital value corresponding to a pulse width of a signal outputted from the comparator 520.

The clock output circuit 330 illustrated in FIG. 5 outputs one of the sub-clock signals CK1 to CK12 as the clock signal CLK, in response to the detection signal S_DET having a digital value. For example, when the detection signal S_DET is a four bit digital signal '0000', the clock output circuit 330 selects the sub-clock signal CK12 among the sub-clock signals CK1 to CK12. When the detection signal S_DET is '0011', the clock output circuit 330 selects the sub-clock signal CK9 among the sub-clock signals CK1 to CK12. In another example, when the detection signal S_DET is 0100, the clock output circuit 330 may select the sub-clock signal CJ8. Thus, the sub-clock selection may change when there is a change to the value of the four bit digital signal.

Figure 11:
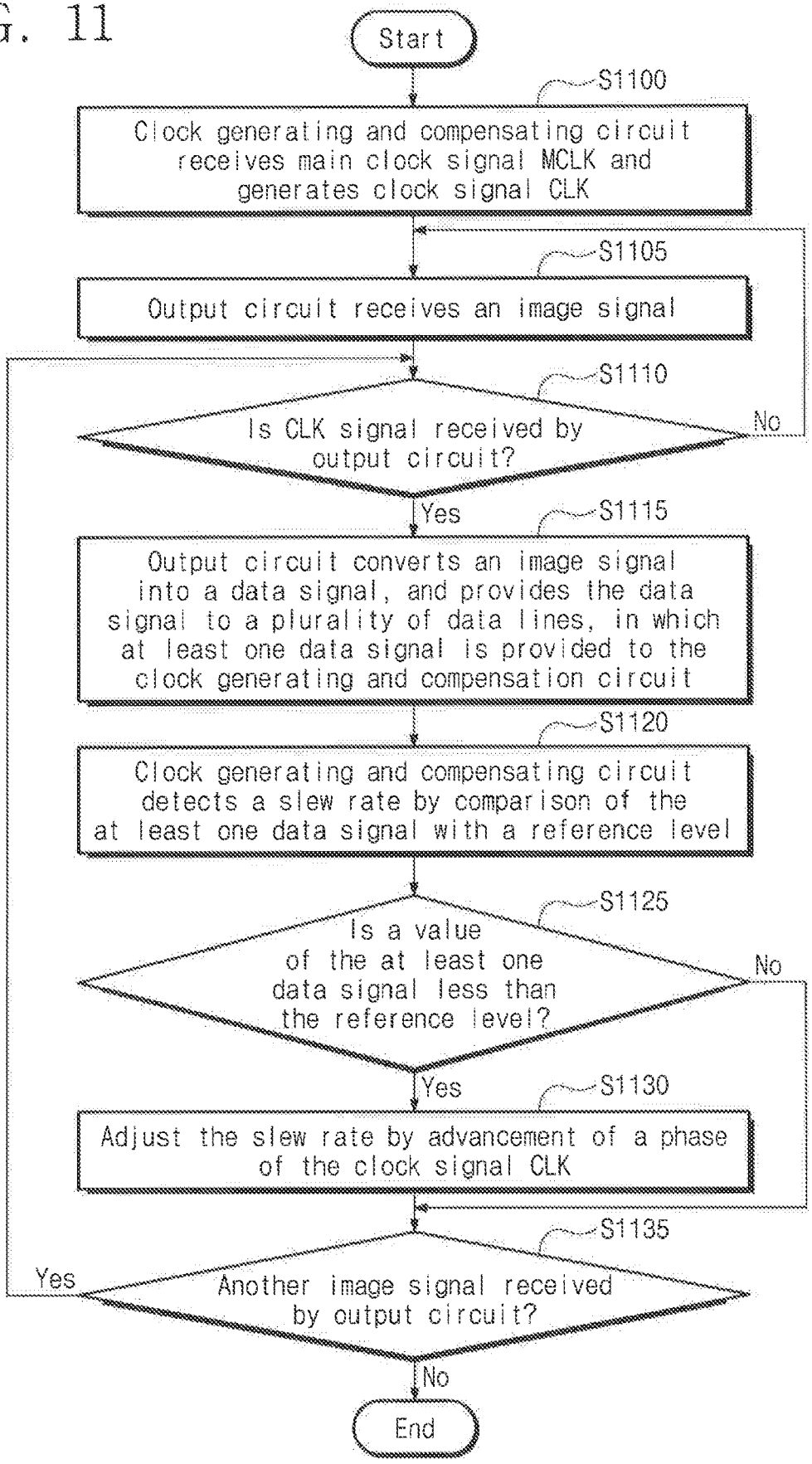
FIG. 11 is a flowchart providing an example of an operation of a data driving circuit according to an embodiment the inventive concept.

FIG. 11 is a flowchart providing an example of an operation of a data driving circuit according an embodiment of the inventive concept. The data driving circuit may be the circuit shown in FIG. 4. A display device having a configuration described above advances a phase of the clock signal when a slew rate of the data signal provided to a pixel is lower than the reference level. The operation of the circuitry is discussed in more detail herein below.

At operation S1100, the clock generating and compensating circuit 210 receives a master clock signal MCLK.

At operation S1105, the output circuit receives an image signal. Next at operation S1110, it is determined whether the CLK signal is received by the output circuit.

If at operation S1110, the CLK signal is received by the output circuit, then at operation S1115, the output circuit converts the image signal into a data signal, and provides the data signal to a plurality of data lines, in which at least one data signal is provided to the clock generating and compensation circuit.

At operation S1120, the clock generating and compensating circuit 210 detects a slew rate by, for example, a comparator circuit comparing a level of at least one data signal with a reference level.

At operation S1125, the comparator determines whether a voltage of the at least one data signal is less than the reference level. If the voltage of the at least one data signal is not less than the reference level, there is no adjustment of the slew rate, and at operation S1135, if there is another image received by the output circuit, them operation S1110 is again performed to determine whether a clock signal output is received by the output circuit to convert the "another" image signal. Otherwise, if another image signal is not received at S1135, the image would be displayed without a slew rate adjustment.

At operation S1130, when it is determined that the value of the least one data signal is less than the reference level (operation S1125), the slew rate is adjusted by advancement of a phase of the clock signal CLK.

Finally at operation S1135, the entire operations would repeat if another image signal is received by the output circuit, or other would end.

Accordingly, a decrease in a charging rate of a pixel due to a low slew rate may be compensated for and an image display stain due to different pixel charging rates may be reduced or prevented. The display device according to the inventive concept can thus address pixel charging inequities caused by variations in the ambient temperature of the respective data driving circuits that may occur due to their relatively different distances from heat generating elements, such as a voltage generator.

Figure 12:
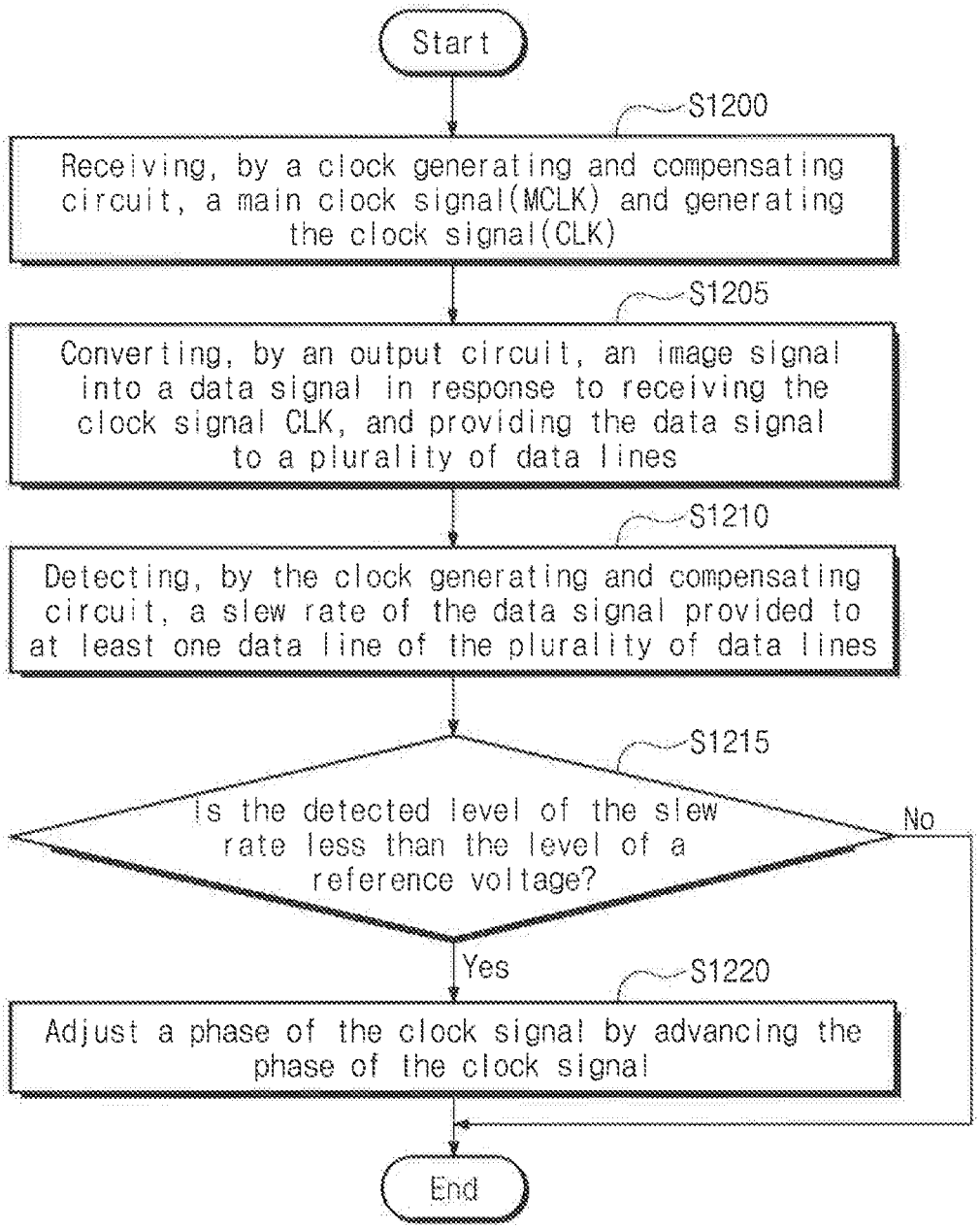
FIG. 12 is a flowchart illustrating a method of performing a charging rate compensation according to an embodiment of the inventive concept.

FIG. 12 is a flowchart illustrating a method of performing a charging rate compensation according to an embodiment of the inventive concept. The method may be performed, for example with a display device of, for example, FIG. 1 and may utilize a clock generating and compensating circuit 210 as in FIGS. 1 and 5, and a driving circuit 120 and an output circuit 220 as in FIGS. 1 and 4.

At operation S1200 a clock generating and compensating circuit may receive a main clock signal MCLK and generate a clock signal CLK.

At operation S1205, there is a converting, by an output circuit, of an image signal into a data signal in response to receiving the clock signal CLK. The data signal may be applied to a plurality of data lines (e.g. DL1 to DLy).

At operation S1210, the clock generating and compensating circuit may detect a slew rate of the data signal provided to at least one data line of the plurality of data lines. A slew rate detector 320, such as shown in FIG. 5 (and in more detail in FIG. 7) receives (in this example) the signal D1 (see also FIG. 1). The slew rate detector 320 may be constructed of an integrator 410 and a comparator 420 that receives the output of the integrator, and the integrator 410 may have a switch 411 that is activated by a switching signal SW1. The integrator may accumulate the amount of current of the data signal (e.g., D1) provided to the data line DL1 while the switching signal that is active, and output an accumulation signal to the comparator 420. The comparator 420 compares the accumulation data signal with a reference voltage Vref2.

At operation S1215, the comparator outputs a signal with a level based on whether or not the slew rate is less than the reference voltage, or greater than the reference voltage. For example, the level of S_DET may be a high level when a voltage level of the accumulation data signal is lower than reference voltage Vref2, and S_DET may be a low level when the accumulation signal is higher than the reference voltage Vref2.

At operation S1220, the phase of the data signal may be adjusted by advancing the phase of the clock signal. In turn, the output points of time of the data signals output from a buffer 224 (FIG. 4) are advanced. The method may end at this time, or the process may repeat for additional data signals. The method according to the inventive concept, may provide for a more uniform charging of the pixels and thus reduce or eliminate the stain that can be seen on a display because the different slew rates of various driving circuits may cause uneven charging of the pixels.

Although the exemplary embodiments of the inventive concept have been described herein, it is to be understood by a person of ordinary skill in the art that various changes and modifications can be made by those skilled in the art within the spirit and scope, defined by the following claims or the equivalents, of the inventive concept.

What is claimed is:

1. A data driving circuit comprising:

a clock generating and compensating circuit configured to receive a main clock signal MCLK and generate a clock signal CLK;

an output circuit configured to convert an image signal into a data signal in response to the clock signal CLK, and provide the data signal to a plurality of data lines; and wherein the clock generating and compensating circuit is configured to detect a slew rate of the data signal provided to at least one data line of the plurality of data lines, and to adjust a phase of the clock signal CLK depending on the detected slew rate.

2. The data driving circuit of claim 1, wherein the clock generating and compensating circuit is configured to advance the phase of the clock signal CLK when the detected slew rate is lower than a reference level.

3. The data driving circuit of claim 1, wherein the clock generating and compensating circuit comprises:

a clock generator circuit configured to receive the main clock signal MCLK, and generate a plurality of sub-clock signals having phases different from each other;

a slew rate detector including circuitry configured to compare the slew rate of the data signal provided to the at least one data line with a reference level, and to output a detection signal; and a clock output circuit configured to output, in response to the detection signal, one of the plurality of sub-clock signals as the clock signal to compensate for the slew rate of the data signal.

4. The data driving circuit of claim 3, wherein the clock output circuit is further configured to receive a vertical synchronization signal, and in response output a switching signal that is active for a predetermined time within a blanking interval of the vertical synchronization signal, and the slew rate detector compares, in response to the switching signal, the slew rate of the data signal provided to the at least one data line with the reference level, and outputs the detection signal.

5. The data driving circuit of claim 4, wherein when the slew rate of the data signal is lower than the reference level, the clock output circuit is configured to output a sub-clock signal, having a phase ahead of a phase of a current clock signal, of the plurality of sub-clock signals as the clock signal CLK from a next frame, in response to the detection signal.

6. The data driving circuit of claim 4, wherein the slew rate detector comprises:

an integrator configured to accumulate an amount of current of the data signal provided to the at least one data line while the switching signal is active, and output an accumulation data signal; and a comparator configured to compare the accumulation data signal with a reference voltage, and output the detection signal.

7. The data driving circuit of claim 6, wherein when a voltage level of the accumulation data signal is lower than the reference voltage, the comparator outputs the detection signal having a high level, and when the voltage level of the accumulation data signal is higher than the reference voltage, the comparator outputs the detection signal having a low level.

8. The data driving circuit of claim 1, wherein the clock generating and compensating circuit comprises:

a clock generator configured to receive the main clock signal MCLK and generate a plurality of sub-clock signals having phases different from each other;

a slew rate detector having circuitry configured to compare the slew rate of the data signal provided to the at least one data line with a reference level, and output a detection signal corresponding to a difference between the slew rate of the data signal and the reference level; and a clock output circuit configured to output a sub-clock signal, corresponding to the detection signal, of the plurality of sub-clock signals as the clock signal.

9. The data driving circuit of claim 8, wherein the slew rate detector comprises:

an integrator circuit configured to accumulate an amount of current of the data signal provided to the at least one data line while the switching signal is active, and output an accumulation data signal;

a comparator circuit configured to compare the accumulation data signal with a reference voltage, and output a comparison signal having a pulse width corresponding to a difference between the accumulation data signal and the reference voltage; and an analog-to-digital converter configured to output the detection signal corresponding to the pulse width of the comparison signal.

10. The data driving circuit of claim 1, wherein the output circuit comprises:

a latch circuit configured to latch the image signal, and output the latched image signal in synchronization with the clock signal CLK;

a digital-to-analog converter configured to convert a digital image signal outputted from the latch circuit into an analog image signal; and an output buffer configured to output the analog image signal as the data signal in synchronization with the clock signal.

11. A display device comprising:

a display panel including a plurality of pixels connected respectively to a plurality of gate lines and a plurality of data lines;

a gate driving circuit configured to drive the plurality of gate lines with a gate-on voltage;

a data driving circuit configured to drive the plurality of data lines; and a drive controller configured to control the gate driving circuit and the data driving circuit in response to a control signal and an image input signal externally provided, and output an image signal corresponding to the image input signal, a vertical synchronization signal, and a main clock signal MCLK, wherein the data driving circuit comprises:

an output circuit configured to convert the image signal into a data signal in response to a clock signal CLK, and provide the data signal to the plurality of data lines; and a clock generating and compensating circuit configured to receive the main clock signal MCLK and the vertical synchronization signal, and generate the clock signal CLK, wherein the clock generating and compensating circuit detects a slew rate of the data signal provided to at least one data line of the plurality of data lines, and adjusts a phase of the clock signal CLK depending on the detected slew rate.

12. The display device of claim 11, wherein the clock generating and compensating circuit advances the phase of the clock signal CLK when the detected slew rate is lower than a reference level.

13. The display device of claim 11, wherein the clock generating and compensating circuit comprises:

a clock generator configured to receive the main clock signal MCLK, and generate a plurality of sub-clock signals having phases different from each other;

a slew rate detector configured to compare the slew rate of the data signal provided to the at least one data line with a reference level, and output a detection signal; and a clock output circuit configured to output, in response to the detection signal, one of the plurality of sub-clock signals as the clock signal CLK.

14. The display device of claim 13, wherein the drive controller is configured to output the main clock signal (MCLK) for a predetermined time within a blanking interval of the vertical synchronization signal, the clock output circuit outputs a switching signal that is active for a predetermined time within the blanking interval of the vertical synchronization signal, and the slew rate detector compares, in response to the switching signal, the slew rate of the data signal provided to the at least one data line with the reference level, and outputs the detection signal.

15. The display device of claim 14, wherein the clock output circuit outputs a sub-clock signal, having a phase ahead of a phase of a current clock signal, of the plurality of sub-clock signals as the clock signal from a next frame, in response to the detection signal.

16. The display device of claim 15, wherein the slew rate detector comprises:

an integrator configured to accumulate an amount of current of the data signal provided to the at least one data line while the switching signal is active, and output an accumulation data signal; and a comparator configured to compare the accumulation data signal with a reference voltage, and output the detection signal.

17. The display device of claim 15, wherein the clock generating and compensating circuit comprises:

a clock generator configured to receive the main clock signal, and generate a plurality of sub-clock signals having phases different from each other;

a slew rate detector configured to compare the slew rate of the data signal provided to the at least one data line with a reference level, and output a detection signal corresponding to a difference between the slew rate of the data signal and the reference level; and a clock output circuit configured to output a sub-clock signal, corresponding to the detection signal, of the plurality of sub-clock signals as the clock signal.

18. The display device of claim 17, wherein the slew rate detector comprises:

an integrator circuit configured to accumulate an amount of current of the data signal provided to the at least one data line while the switching signal is active, and output an accumulation data signal;

a comparator circuit configured to compare the accumulation data signal with a reference voltage, and output a comparison signal having a pulse width corresponding to a difference between the accumulation data signal and the reference voltage; and an analog-to-digital converter configured to output the detection signal corresponding to the pulse width of the comparison signal.

19. The display device of claim 11, wherein the output circuit comprises:

a latch circuit configured to latch the image signal, and output the latched image signal in synchronization with the clock signal CLK.;

a digital-to-analog converter including a circuit configured to convert a digital signal outputted from the latch circuit into an analog signal; and an output buffer configured to output the analog signal as the data signal in synchronization with the clock signal CLK, wherein output points of time of the data signal us advanced by predetermined time.

20. A method of detecting and compensating for a slew rate of a data in a data driving circuit, the method comprising:

receiving, by a clock generating and compensating circuit, a main clock signal MCLK and generating a clock signal CLK, converting, by an output circuit, an image signal into a data signal in response to receiving the clock signal CLK, and providing the data signal to a plurality of data lines; and detecting, by the clock generating and compensating circuit, a slew rate of the data signal provided to at least one data line of the plurality of data lines, and adjusting a phase of the clock signal CLK depending on the detected slew rate, wherein the adjusting of the phase of the clock signal includes advancing, by the clock generating and compensating circuit, the phase of the clock signal CLK to advance output points of time of the data signal.

* * * * *